US006733634B2

(12) United States Patent
Van Rengen et al.

(10) Patent No.: US 6,733,634 B2
(45) Date of Patent: May 11, 2004

(54) APPARATUS, SYSTEM AND METHOD FOR TRANSFERRING A RUNNING WEB

(75) Inventors: Edward J. Van Rengen, Evans, GA (US); Andrew Krause, Clintonville, WI (US); Keith D. Glass, Appleton, WI (US); David Wilhelm, Philadelphia, PA (US); Lennis W. Rindy, Neenah, WI (US); Daniel Sprangers, Kaukauna, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 21 days.

(21) Appl. No.: 09/964,280

(22) Filed: Sep. 26, 2001

(65) Prior Publication Data

US 2003/0056926 A1 Mar. 27, 2003

(51) Int. Cl.[7] ..... D21F 1/36; D21F 3/10; D21F 1/48

(52) U.S. Cl. ..... 162/363; 162/364; 162/370; 34/117; 226/91; 226/97.4

(58) Field of Search ..... 162/363, 370, 162/193; 34/114, 117; 226/97.3, 91, 7

(56) References Cited

U.S. PATENT DOCUMENTS

| | | | | | |
|---|---|---|---|---|---|
| 1,279,170 | A | * | 9/1918 | Sullivan | 162/366 |
| 4,113,557 | A | * | 9/1978 | Kankaanpaa | 162/301 |
| 4,440,597 | A | | 4/1984 | Wells et al. | |
| 4,757,619 | A | | 7/1988 | Villalobos | |
| 4,893,741 | A | * | 1/1990 | Heinzmann | 242/615 |
| 4,960,333 | A | * | 10/1990 | Faye et al. | 384/448 |
| 5,098,522 | A | | 3/1992 | Smurkoski et al. | |
| 5,152,078 | A | | 10/1992 | Wedel | |
| 5,609,728 | A | * | 3/1997 | Durden | 162/205 |
| 5,718,806 | A | * | 2/1998 | Trokhan et al. | 162/363 |
| 5,725,734 | A | * | 3/1998 | Herman et al. | 162/111 |
| 5,741,402 | A | * | 4/1998 | Trokhan et al. | 162/374 |
| 5,744,007 | A | | 4/1998 | Trokhan et al. | |
| 5,776,311 | A | | 7/1998 | Trokhan et al. | |
| 5,830,321 | A | | 11/1998 | Lindsay et al. | |
| 5,855,739 | A | | 1/1999 | Ampulski et al. | |
| 5,885,421 | A | * | 3/1999 | Ensign et al. | 162/306 |
| 5,904,811 | A | | 5/1999 | Ampulski et al. | |
| 6,080,279 | A | | 6/2000 | Hada et al. | |
| 6,083,346 | A | | 7/2000 | Hermans et al. | |
| 6,093,284 | A | | 7/2000 | Hada et al. | |
| 6,096,169 | A | | 8/2000 | Hermans et al. | |
| 6,143,135 | A | | 11/2000 | Hada et al. | |
| 6,149,767 | A | | 11/2000 | Hermans et al. | |
| 6,306,262 | B1 | * | 10/2001 | Snellman et al. | 162/363 |
| 6,322,669 | B1 | * | 11/2001 | Leinonen | 162/217 |

FOREIGN PATENT DOCUMENTS

| | | |
|---|---|---|
| EP | 0617164 | 9/1994 |
| WO | 9002840 | 3/1990 |
| WO | 9855686 | 12/1998 |

OTHER PUBLICATIONS

PCT Search Report Nov. 14, 2002.

* cited by examiner

*Primary Examiner*—José A. Fortuna
(74) *Attorney, Agent, or Firm*—Dority & Manning, P.A.

(57) ABSTRACT

An improved system, apparatus and method is disclosed for transferring a running web from a first carrier fabric to a second carrier fabric in the manufacture of webbed products, such as tissue, paper toweling, and the like. A multi-stage vacuum process applies a vacuum to the running web. One or more auxiliary units apply a vacuum to one or more edge portions of the running web. The apparatus provides for a reliable and efficient transfer of the running web among carrier fabrics, in which the carrier fabrics may include topographical features upon their surface.

24 Claims, 4 Drawing Sheets

APPARATUS, SYSTEM AND METHOD FOR TRANSFERRING A RUNNING WEB

BACKGROUND OF THE INVENTION

Modern machinery for processing running webs into paper products, such as tissue and paper toweling, employs a vacuum applied to the running web to adhere the running web to a moving carrier fabric. Several carrier fabrics may coordinate together, and each carrier fabric typically moves in an endless loop. The running web is transferred from one carrier fabric to another carrier fabric during the papermaking process, beginning at a headbox slurry and ending with a finished product of one or more layers.

Historically, flat carrier fabrics have been used to manufacture such products. However, in many modern uncreped through air dried ("UCTAD") tissue making processes, some of the carrier fabrics used are not flat, and include a raised pattern projecting from the fabric surface that includes topographical features.

It is a significant manufacturing challenge to reliably and securely transfer a running web when the fabric employed to carry the running web is not flat. Flat carrier fabrics tend to hold tightly the running web with a minimal amount of vacuum applied to the running web, while a carrier fabric employing topographical features typically requires a greater degree of vacuum pressure to reliably hold the running web in place upon the surface of the carrier fabric. Thus, a need exists to provide improved methods and apparatus for transferring running webs from one carrier fabric to another carrier fabric, especially for carrier fabrics that employ topographical features.

The amount of vacuum that must be applied to tightly adhere a running web to a moving carrier fabric varies. The vacuum must be great enough to ensure reliable transfer, but not so great as to damage the product. For example, if the level of vacuum is too high, undesirable holes or defects may be formed in the running web. Thus, one significant challenge in the papermaking industry is to regulate the level of vacuum applied to a carrier fabric to ensure a reliable manufacturing process that produces a high quality product.

The apparatus used to transfer a running web from one moving carrier fabric to another is commonly called a "pick up box", or "box." The reservoir or manifold connected to the "box" employing a vacuum is sometimes called a "vacuum box." Vacuum boxes typically have been oriented across the entire width (i.e. cross direction) of a running web. Pick up boxes apply a vacuum force to rapidly and securely pull a running web from a first fabric to a second fabric.

Unfortunately, web transfer difficulty is sometimes experienced near the edges of the running web. That is, the medial portion of the running web may transfer well, but the edges may not transfer reliably to the receiving carrier fabric, which can be a significant problem. This problem may be especially pronounced at low transfer vacuum levels. In some applications, the problem may occur in part because web edges are not smooth and flat during transfer. Poor edge transfer sometimes causes the running web to strike downstream equipment, such as a through air dryer, causing a web "pile-up", which may result in undesirable production problems.

What is needed in the industry is an apparatus, system and method for transferring a running web among several carrier fabrics in a secure and reliable manner, while avoiding or minimizing damage to the final manufactured product. A transfer that secures the edge of the running web to the receiving carrier fabric without damaging equipment or causing production problems would be highly desirable. An apparatus or method that is capable of performing the transfer at relatively low vacuum levels would be especially desirable.

SUMMARY OF THE INVENTION

A vacuum apparatus for a papermaking machine is provided in one embodiment. The papermaking machine provides at least a first and second carrier fabric, said first and second carrier fabrics each having a machine direction and a cross direction perpendicular to the machine direction. In combination, a running web is provided for travel on the apparatus, the running web being adapted to proceed in the machine direction. The running web includes a width in the cross direction, the running web being bounded by a first edge and a second edge. In one aspect of the invention, a primary head is positioned adjacent to and in fluid communication with the running web. A primary vacuum box may be joined to the primary head, the primary vacuum box having on its interior a first region of reduced air pressure. The primary vacuum box may extend in the cross direction and can be adapted for applying reduced air pressure to the primary head for application to the running web in transferring the web from the first carrier fabric to the second carrier fabric.

A first auxiliary head also may be positioned adjacent to and in fluid communication with the first edge of the running web. Furthermore, an auxiliary vacuum box is joined to said first auxiliary head, the auxiliary vacuum box having an auxiliary region of reduced air pressure, the auxiliary vacuum box extending in the cross direction. The auxiliary vacuum box is adapted for applying reduced air pressure to the first auxiliary head for application to at least the first edge of the running web.

In another aspect of the invention, a second auxiliary head is provided and is adapted for applying reduced air pressure. In some applications, the first auxiliary head is applied to a first edge of the running or carrier fabric, while the second auxiliary head is applied to a second edge of the carrier fabric.

In some embodiments of the invention, there may be one or more auxiliary heads and/or vacuum boxes, without a primary vacuum box. That is, auxiliary vacuum boxes may be applied in essentially any location where edges of a running web must be stabilized against a carrier fabric.

A system also is provided for transferring a running web from a first carrier fabric to a second carrier fabric. The system includes a running web having a cross direction extending from a first edge to a second edge. The running web is configured for traveling in a machine direction from an upstream end of the manufacturing process to the downstream end of the process. A primary head is positioned adjacent to and in fluid communication with the running web. The primary head includes a primary contact means for application to the running web, the primary contact means extending in the cross direction of the running web. The primary contact means forms a vacuum slot adjacent to the running web.

A primary vacuum box is joined to the primary head, the primary vacuum box having an interior region of reduced air pressure. The primary vacuum box is adapted for applying reduced air pressure to the vacuum slot of the primary contact means for application to the running web to transfer the running web from the first carrier fabric to the second carrier fabric. The first auxiliary head may be positioned downstream from the primary head. The first auxiliary head includes a first auxiliary contact means extending in the cross direction of the running web and in contact with the running web. The first auxiliary head typically is provided adjacent to and in fluid communication with the first edge of the running web. A first auxiliary vacuum box is joined to the first auxiliary head. The first auxiliary vacuum box includes an auxiliary region of reduced air pressure. The auxiliary vacuum box is adapted for applying reduced air pressure to the auxiliary contact means for application to the first edge of the running web. In some applications, the auxiliary contact means comprises two lips having a vacuum slot between the lips. In such applications, the lips are applied to the surface of the carrier fabric to pull a vacuum through the fabric, thereby adhering the running web to the carrier fabric.

A process also is provided for manufacturing paper from a web in a papermaking machine. The process includes applying a first suction force at a first point on the web, and a second suction force at a second point which is downstream from the first suction force. These forces, acting together, transfer the web from the first carrier fabric to a second carrier fabric. The second suction force is applied to the first and second edges of the web, thereby completing transfer the web from a first carrier fabric to a second carrier fabric.

BRIEF DESCRIPTION OF THE DRAWINGS

A full and enabling disclosure of this invention, including the best mode shown to one of ordinary skill in the art, is set forth in this specification. The following Figures illustrate the invention.

DETAILED DESCRIPTION OF THE INVENTION

Figure 1:
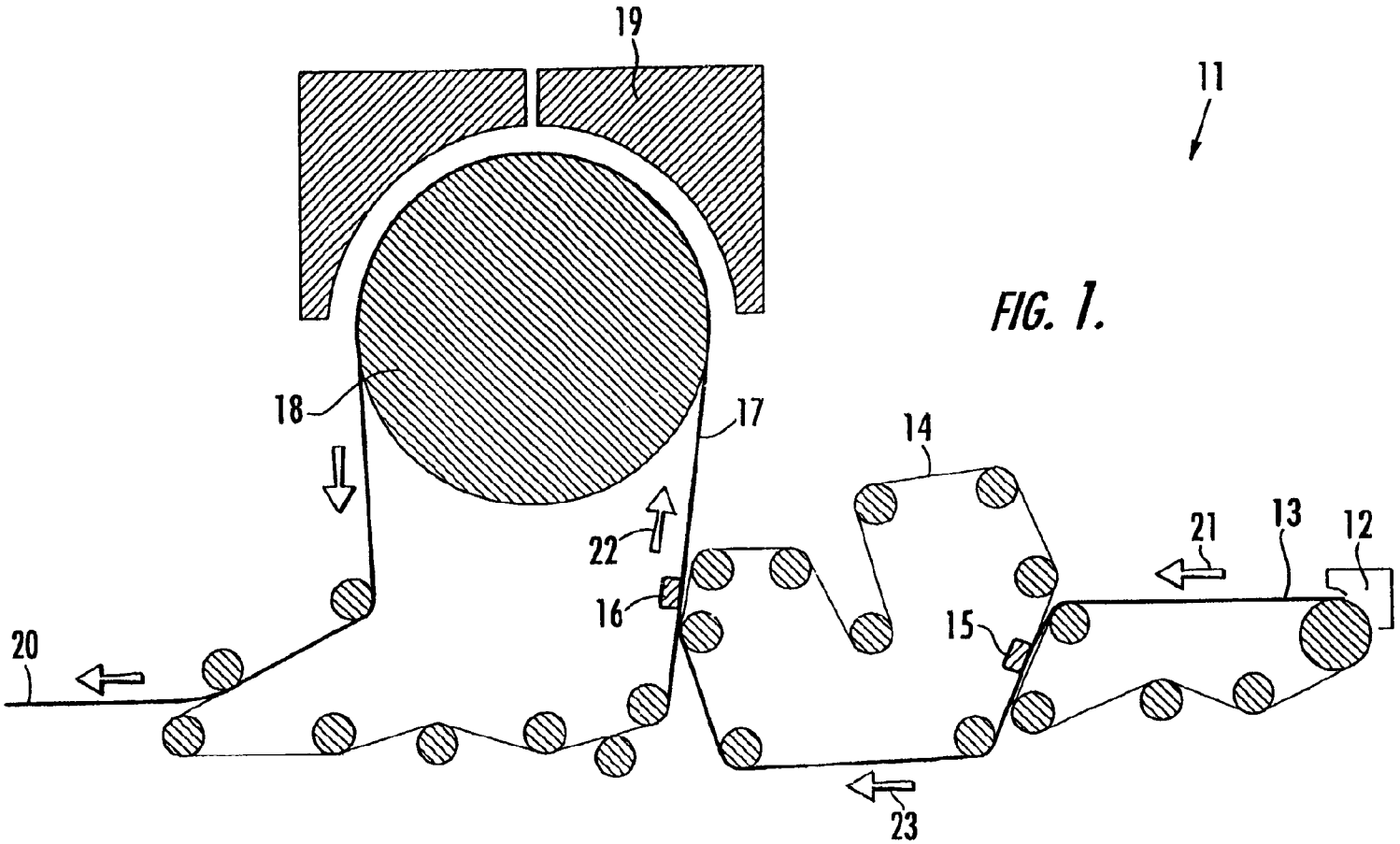
FIG. 1 is an overview of a portion of the apparatus employed to produce paper products such as tissue, paper toweling and the like from a paper slurry.

Reference now will be made to the embodiments of the invention, one or more examples of which are set forth below. Each example is provided by way of explanation of the invention, not as a limitation of the invention. In fact, it will be apparent to those skilled in the art that various modifications and variations can be made in this invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents. Other objects, features and aspects of the present invention are disclosed in or are obvious from the following detailed description. It is to be understood by one of ordinary skill in the art that the present discussion is a description of exemplary embodiments only, and is not intended as limiting the broader aspects of the present invention, which broader aspects are embodied in the exemplary constructions.

The application of the invention of this application facilitates the use of relatively low transfer vacuum levels when using a pick-up shoe or vacuum box to transfer a web onto a highly topographical fabric. Many carrier fabrics used in uncreped through-air-dried ("UCTAD") processes provide a relatively high degree of topography on the surface of the fabric that contributes to the need for improved efficiency in the vacuum transfer process. The invention may assist in avoiding transfer difficulty, especially difficulty that occurs at the edges of the running web when an attempt is made to transfer at relatively low levels of vacuum. The application of the invention facilitates the use of lower levels of vacuum, which may result in a superior product, reduced energy costs, or more reliable production of product. The use of auxiliary pick-up boxes positioned at one or more edges of the running web facilitates a relatively clean and reliable transfer of the entire running web from one carrier fabric to another.

In papermaking, the term "machine direction", or "MD", refers to that direction which is parallel to the flow of the running paper web through the equipment. The "cross-direction", or "CD", is generally perpendicular to the machine direction and lies in the plane of the papermaking carrier fabric. The machine direction and cross direction are indicated by arrows in several Figures of the application, described below.

Essentially any carrier fabric may be used in the application of the invention. Transfer of a running web typically occurs when centripetal acceleration or air pressure applied from a transfer head causes the web to move from one carrier fabric to another carrier fabric. The invention provides particular assistance when using carrier fabrics that have a topography or uneven feature on the surface of the carrier fabric. A fabric having a relatively high permeability to fluids such as water and air is typically used in the practice of the invention. Any papermaking belt suitable for use in a through-drying process, or UCTAD process, may be utilized in the practice of the invention. For example, papermaking belts such as those shown in U.S. Pat. Nos. 4,529,480; 4,514,345; 4,637,859; and 5,334,289 may be employed in the practice of the invention. Topographical fabrics that may be employed in the practice of the invention may be supplied by various manufacturers such as Voith Fabrics, Asten, and others. Many types of fabric can be employed in the practice of the invention.

In some applications, it is possible to employ a pressure at the primary head of the vacuum box of no more than about 8.5 inches of Mercury. Furthermore, in still other applications it is possible to demonstrate transfer of a running web using a pressure of 4 inches of Mercury or less. It may be possible to use levels as low as 1 inch or less of Mercury, depending upon the particular carrier fabric used and processing conditions.

Figure 2:
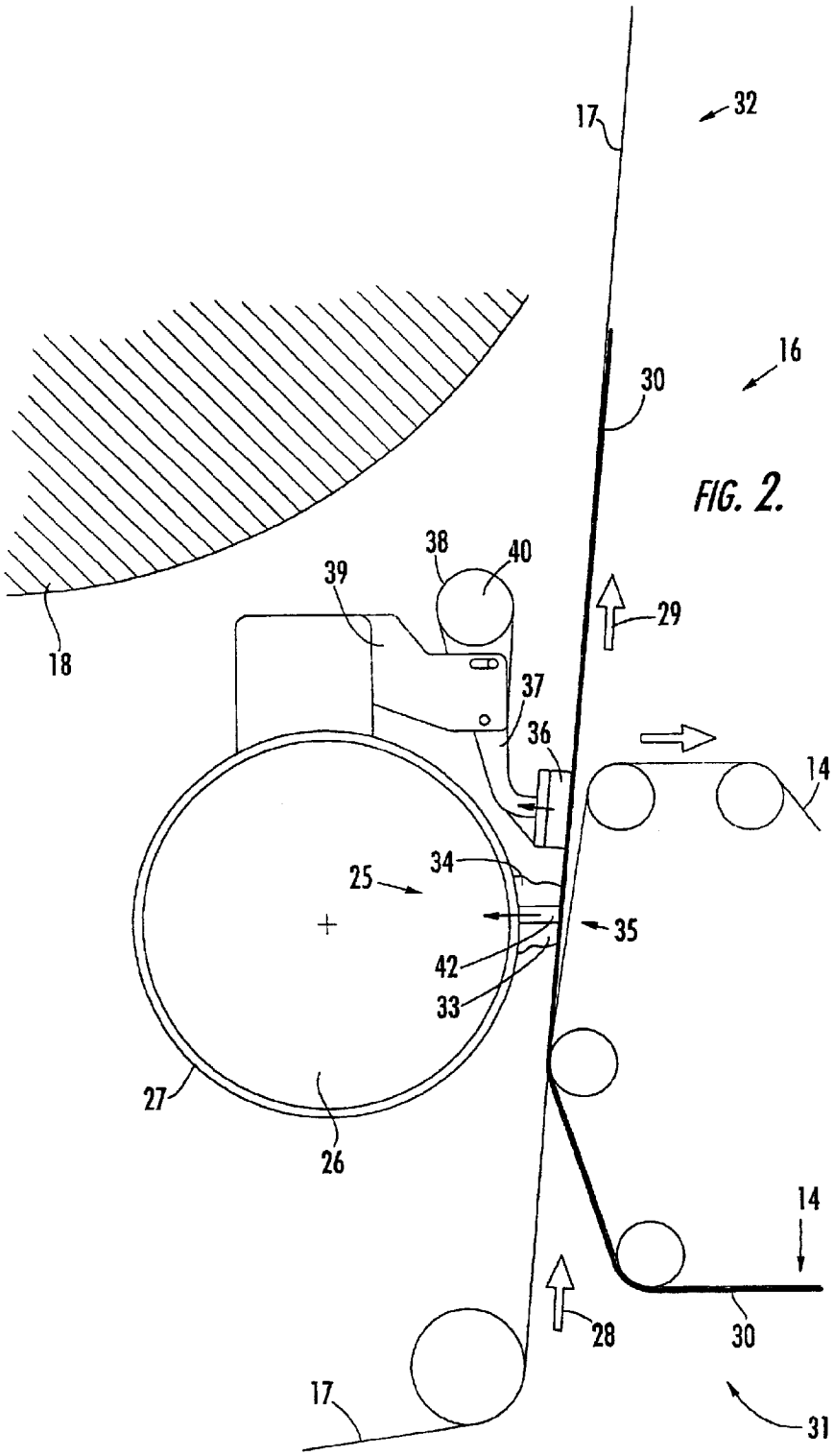
FIG. 2 reveals a closer side view of the vacuum apparatus employed in transferring a running web from a first carrier fabric to a second carrier fabric in the manufacture of web-based products.

Turning now to FIGS. 1 and 2, a papermaking apparatus 11 is shown comprising a former 13, which receives a paper slurry from headbox 12. A sheet is formed as the former 13 proceeds in the machine direction 21 as shown in the right side of FIG. 1. Vacuum apparatus 15 transfers the sheet which is being formed (not shown) to the first carrier fabric 14. Then, the running web proceeds along the direction arrow 23 to the vacuum apparatus 16, which transfers the running web to a second carrier fabric 17. The machine direction 22 is shown by reference to the arrow 29. The dryer 18, is the structure around which the second carrier fabric 17 travels in drying the running web. A dryer hood 19 is shown over the top portion of the dryer 18. Finally, a product 20 emerging from the papermaking apparatus 11 as shown on the left side of FIG. 1.

In FIG. 2, the vacuum apparatus 16 of FIG. 1 is shown in greater detail. The first carrier fabric 14 carries the running web 30 along the machine direction 28 to the transfer zone 35. It is in the transfer zone 35 that the running web 30 is transferred from the first carrier fabric 14 to the second carrier fabric 17. The transfer is accomplished by applying vacuum pressure or a suction force which moves the running web 30 from the surface of the first carrier fabric 14 and to the surface of the second carrier fabric 17. A primary head 25 or primary contact means applies air pressure between a first lip 33 and a second lip 34. In FIG. 2, the "upstream" end of the process is indicated at 31, and the "downstream" end of the process is indicated at 32.

A primary vacuum box 27 having a region 26 of reduced air pressure is shown on the left side of FIG. 2. The reduced air pressure in region 26 is applied to the vacuum slot 42 which is located between the first lip 33 and the second lip 34.

Further downstream from the primary head 25 is the auxiliary head 36. The auxiliary head 36 assists in pulling by vacuum force, the edges of the running web 30 from the first carrier fabric 14 to the second carrier fabric 17 to effect a complete and reliable transfer. In some cases, the distance between the auxiliary head 36 and the primary head 25 is about 5 or 6 inches. However, in other applications of the invention it might be possible to provide such a distance which is less than one inch or as great as 1 or 2 feet, or even more.

An auxiliary vacuum box 37 is fluidly connected to the auxiliary head 36. A vacuum supply tube inlet 38 is shown, having an auxiliary region 40 of reduced air pressure which is seen in FIG. 2. A mounting bracket 39 supports the auxiliary vacuum box 37, and in this particular embodiment, connects it to the primary vacuum box 27 for support. Other mounting arrangements are possible in the practice of the invention. A portion of the dryer 18 may be seen in the upper left portion of FIG. 2.

Figure 3:
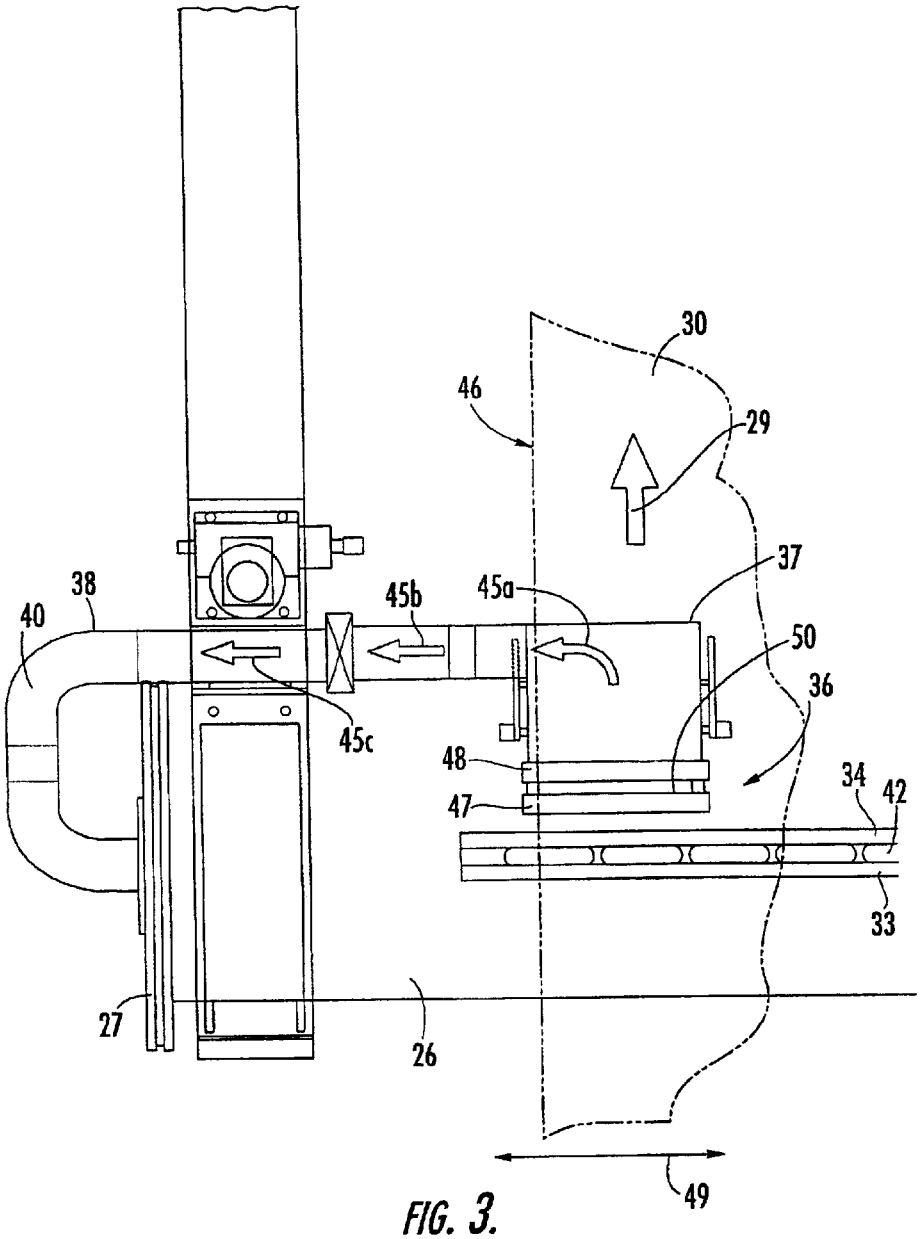
FIG. 3 shows a portion of an end view of the apparatus shown in FIG. 2, in which the first edge 46 of the running web 30 is shown in relation to the vacuum apparatus.

If one observes the apparatus shown in FIG. 2 from the right side, as if looking "through" the first carrier fabric 14, one would see a view similar to that shown in FIG. 3. Thus, FIG. 3 is an end view of the apparatus shown in FIG. 2. FIG. 3 only shows, however, a portion of the apparatus of FIG. 2, and in particular it shows the first edge 46 of the running web 30.

In FIG. 3, the running web 30 is moving from the bottom of FIG. 3 towards the top of FIG. 3, along the pathway 29 of the running web 30. Thus, the arrow indicated as pathway 29 is in the machine direction. The auxiliary vacuum box 37 is shown near the center of FIG. 3, and comprises first lip 47 and second lip 48 which are directly in contact with the underside of the running web 30. Furthermore, the primary vacuum box 27 pulls air through a first auxiliary contact means such as a vacuum slot 42, which is bounded by first lip 33 and second lip 34, which extend essentially the full width of the running web 30. In most applications, two separate auxiliary vacuum boxes 37 will be supplied, one on the first edge 46 of the running web 30, and another on the second edge (not shown in FIG. 3) of the running web. The air flow or suction force applied through the running web 30 proceeds into the auxiliary vacuum box 37, and moves along arrows 45*a–c*, as shown in FIG. 3, from right to left in the Figure. The air moves along vacuum supply tube inlet 38. The auxiliary region 40 of reduced air pressure is shown as well, and primary vacuum box 27 is shown in FIG. 3 having region 26 of reduced air pressure. The cross direction (CD) of the running web is shown extending from the left margin to the right margin of FIG. 3, as shown in cross directional arrow 49.

Figure 4:
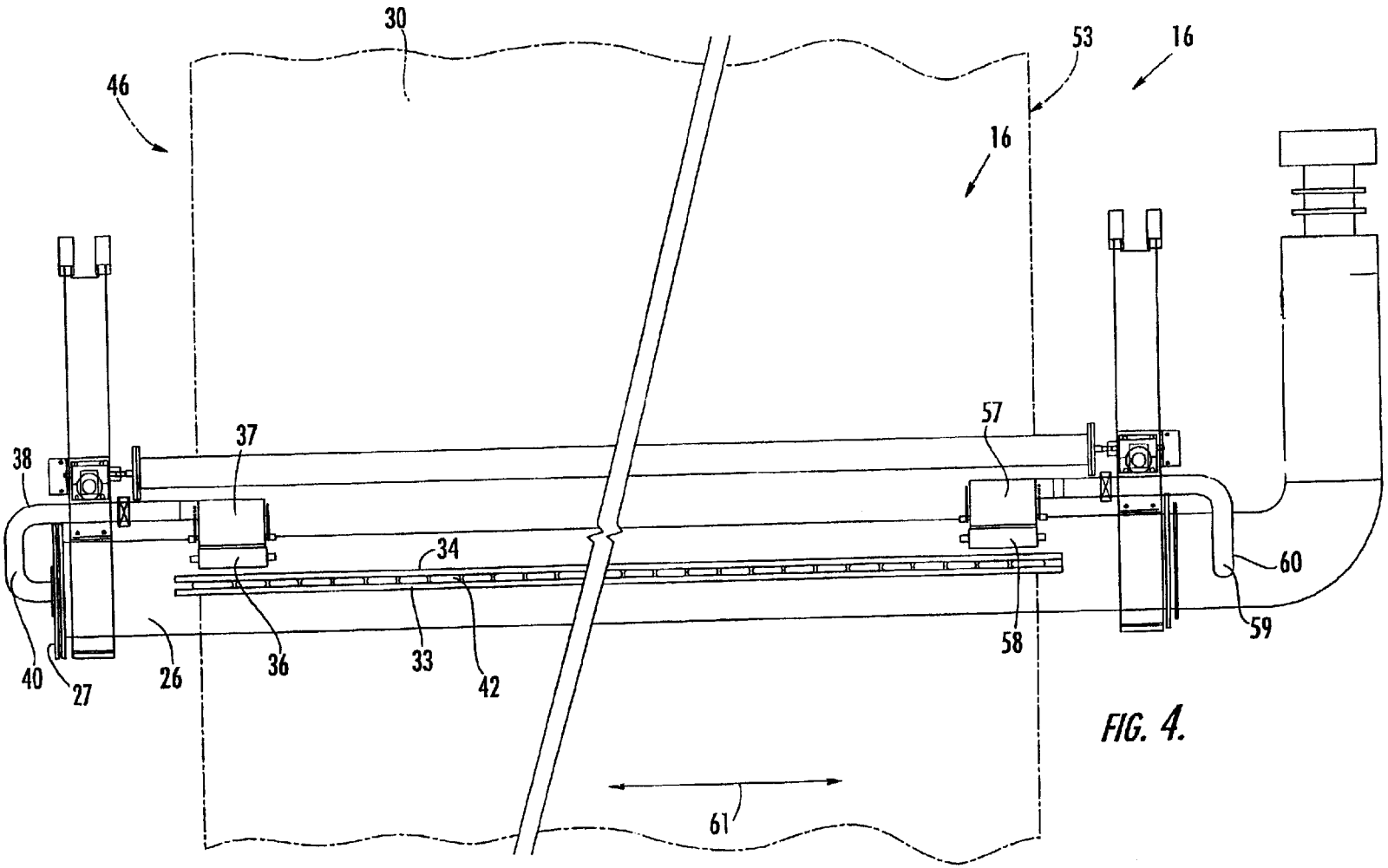
FIG. 4 is a machine directional view of the entire apparatus.

The width of the vacuum slot 50 in the auxiliary head 36, which is bounded by first lip 47 and first lip 48, may be varied. Deckle strips (not shown) are usually employed upon the vacuum slot 50. However, a slot width of about 0.75 inches is believed to be acceptable but could be as great as 4–6 inches or as little as 0.2 inches, depending upon the application. A width of between 0.5 and 1.5 inches is desirable. A length of the slot which corresponds to about 1 foot in the cross direction 49 may be used. However, there is no practical limit on the slot length, and the vacuum slot 50 could extend the entire width of the running web 30, or instead be abbreviated to only a portion of the cross directional distance, as along the edge of running web 30, as shown in FIGS. 3–4. A slot length of between 6 inches and two feet is desirable.

The level of vacuum that must be employed to correctly and reliably transfer the running web 30, while still avoiding damage to the running web 30, will vary depending upon the particular application. However, it is believed that vacuum levels of about 6 inches of Mercury may be employed in some applications, while other applications may permit a reduced vacuum level of less than 6 inches, such as 4 inches or perhaps even as low as 2 inches, depending upon the fabric used and the processing conditions.

The region 26 of reduced air pressure and the auxiliary region 40 of reduced air pressure may be in fluid communication, and may be pumped to a vacuum using the same apparatus. However, depending upon the configuration, is also possible for these two regions to be separate, and not in fluid communication, and therefore capable of imparting differing pressure values concurrently. One means that could be employed to provide a pressure drop would be to use a valve or valve assembly (not shown).

In FIG. 4, a cross-directional width of the vacuum apparatus 16 is shown with both the left and right sides of the apparatus displayed. On the left side of FIG. 4, a vacuum supply tube inlet 38 is fluidly connected to the auxiliary vacuum box 37. On the right side of FIG. 4, a vacuum supply tube inlet 60 is fluidly connected to the second auxiliary vacuum box 57. A second auxiliary head 58 is connected to the second auxiliary vacuum box 57, and is applied to the second edge 53 of the running web 30. On the left side of FIG. 4, the auxiliary head 36 is applied to the first edge 46 of the running web, as previously shown in FIG. 3. FIG. 4 also shows the auxiliary region of reduced air pressure 40 on the left side of the Figure, and the auxiliary region of reduced air pressure 59 within the vacuum supply tube inlet 60. The first lip 33 and second lip 34 form the primary vacuum means which extends essentially the full width along the cross direction 61 of the running web (running web not shown in FIG. 4). Thus, the first lip 33 and second lip 34 are applied directly to the surface of the running web 30 (running web 30 not shown in FIG. 4) in applying a vacuum to the running web 30. A vacuum slot 42 is located between the first lip 33 and the second lip 34. A primary vacuum box 27 is shown which is in fluid connection with the first lip 33 and second lip 34 of the vacuum apparatus 16.

It is understood by one of ordinary skill in the art that the present discussion is a description of exemplary embodiments only, and is not intended as limiting the broader aspects of the present invention, which broader aspects are embodied in the exemplary constructions. The invention is shown by example in the appended claims, but is not limited to the specific features recited in the claims.

What is claimed is:

1. A vacuum apparatus in a papermaking machine, the papermaking machine providing at least a first and a second carrier fabric, said first and second carrier fabrics each having a machine direction and a cross direction perpendicular to the machine direction, in combination a running web adapted for travel in the machine direction, the running web having a width in the cross direction bounded by a first edge and a second edge, the apparatus comprising:

(a) a primary head positioned adjacent to and in fluid communication with the running web, (b) a primary vacuum box joined to said primary head, the primary vacuum box having on its interior a first region of reduced air pressure, the primary vacuum box extending in the cross direction and adapted for a suction force to said primary head for application to the running web in transferring the running web from the first carrier fabric to the second carrier fabric, (c) a first auxiliary head positioned downstream from the primary head, said first auxiliary head being positioned adjacent to and in fluid communication with at least the first edge of the running web, the first auxiliary head also extending over only a portion of the web in the cross direction, and (d) an auxiliary vacuum box joined to said first auxiliary head, the auxiliary vacuum box having an auxiliary region of reduced air pressure, the auxiliary vacuum box extending in the cross direction and adapted for applying reduced air pressure to said first auxiliary head for application to at least the first edge of the running web.

2. The vacuum apparatus of claim 1 in which the vacuum apparatus further comprises a second auxiliary head adjacent to and in fluid communication with the second edge of the running web.

3. The vacuum apparatus of claim 2 in which a second auxiliary vacuum box is applied to the second edge of the running web.

4. The vacuum apparatus of claim 2, wherein the second auxiliary head extends over only a portion of the web in a cross direction.

5. The vacuum apparatus of claim 1 in which the primary vacuum box extends in the cross direction at least the full width of the running web from the first edge to said second edge.

6. The vacuum apparatus of claim 1 in which the first auxiliary head includes a vacuum slot.

7. The vacuum apparatus of claim 6 in which the vacuum slot is about 0.75 inches in width in the machine direction.

8. The vacuum apparatus of claim 6 which the vacuum slot is about 1 foot in length in the cross direction.

9. The vacuum apparatus of claim 6 in which the vacuum slot of the first auxiliary head is bounded by a first lip and a second lip.

10. The vacuum apparatus of claim 9 in which the first lip and the second lip form the downstream and upstream boundaries of a vacuum slot.

11. The vacuum apparatus of claim 1 in which the pressure applied from the primary head of the primary vacuum box to the running web is no more than about 8.5 inches of Mercury.

12. The vacuum apparatus of claim 11 in which the pressure applied is between about 6 inches and about 8.5 inches of Mercury.

13. The vacuum apparatus of claim 1 in which the pressure applied from the primary head of the primary vacuum box to the running web is no more than about 4 inches of Mercury.

14. The vacuum apparatus of claim 1 in which the first carrier fabric includes topographical features.

15. The vacuum apparatus of claim 14 in which the second carrier fabric further comprises topographical features.

16. The vacuum apparatus of claim 1 in which the first region of reduced air pressure and the auxiliary region of reduced air pressure are in fluid communication with each other.

17. The vacuum apparatus of claim 1 in which the first region of reduced air pressure and the auxiliary region of reduced air pressure are not in fluid communication with each other such that said first region and said auxiliary region are capable of applying to the running web differing air pressure values.

18. The vacuum apparatus of claim 1 in which the first auxiliary box is about 15 inches wide in the cross direction.

19. A system for transferring a running web from a first carrier fabric to a second carrier fabric, the system comprising:

(a) a running web, the running web having a cross direction extending from a first edge to a second edge, the running web being configured for traveling in a machine direction from an upstream end to a downstream end, the machine direction being perpendicular to the cross direction, (b) a primary head positioned adjacent to and in fluid communication with the running web, the primary head having a primary contact means for application to the running web, the primary contact means extending in the cross direction of the running web, said primary contact means forming a vacuum slot adjacent to the running web, (c) a primary vacuum box joined to said primary head, the primary vacuum box having an interior region of reduced air pressure, the primary vacuum box being adapted for applying reduced air pressure to the vacuum slot of said primary contact means for application to the running web in transferring the running web from the first carrier fabric to the second carrier fabric, (d) a first auxiliary head positioned downstream from said primary head, said first auxiliary head having a first auxiliary contact means extending in the cross direction of the running web and in contact with the running web, said first auxiliary head being provided adjacent to and in fluid communication with the first edge of the running web, the first auxiliary head also extending over only a portion of the web in the cross direction, and (e) a first auxiliary vacuum box joined to said first auxiliary head, the first auxiliary vacuum box having an auxiliary region of reduced air pressure, the first auxiliary vacuum box being adapted for applying said reduced air pressure to a first auxiliary contact means for application to the first edge of the running web.

20. The system of claim 19 in which the first auxiliary contact means further comprises at least one lip extending in the cross direction of the running web.

21. The system of claim 19 in which the pressure applied from the primary head of the primary vacuum box is no more than about 6 inches of Mercury.

22. The system of claim 21 in which said pressure applied is less than about 1 inch of Mercury.

23. The system of claim 19 in which a second auxiliary vacuum box is applied to the running web.

24. The system of claim 23, in which the second auxiliary vacuum box includes a second auxiliary head positioned downstream from the primary head, the second auxiliary head having an auxiliary contact means extending in a cross direction of the running web and in contact with the running web, the second auxiliary head being provided adjacent to and in fluid communication with the second edge of the running web, the second auxiliary head extending over only a portion of the web in the cross direction.

* * * * *